US010286698B2

(12) United States Patent
Masuzawa et al.

(10) Patent No.: US 10,286,698 B2
(45) Date of Patent: May 14, 2019

(54) PRINTER, PRINTING METHOD, AND PRINT MEDIUM

(71) Applicant: SEIKO EPSON CORPORATION, Tokyo (JP)

(72) Inventors: Kenta Masuzawa, Sapporo (JP); Masahiko Hirasawa, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/806,042

(22) Filed: Nov. 7, 2017

(65) Prior Publication Data

US 2018/0126761 A1 May 10, 2018

(30) Foreign Application Priority Data

Nov. 9, 2016 (JP) ..... 2016-218647

(51) Int. Cl.
*B41J 29/38* (2006.01)
*B41J 11/00* (2006.01)
*B41J 2/01* (2006.01)

(52) U.S. Cl.
CPC ..... *B41J 29/38* (2013.01); *B41J 11/009* (2013.01); *B41J 2/01* (2013.01)

(58) Field of Classification Search
CPC ..... B41J 11/009; B41J 29/38
See application file for complete search history.

(56) References Cited

U.S. PATENT DOCUMENTS 6,386,671 B1 * 5/2002 Huston ..... B41J 3/01 235/462.08
7,533,954 B2 * 5/2009 Nakazawa ..... B41J 11/009 347/105
7,845,786 B2 * 12/2010 Konno ..... B41J 2/0057 347/102
2010/0097649 A1 4/2010 Akiyama

FOREIGN PATENT DOCUMENTS

JP 2010-102398 5/2010
JP 2012-076358 4/2012

* cited by examiner

*Primary Examiner* — Lamson D Nguyen
(74) *Attorney, Agent, or Firm* — Workman Nydegger

(57) ABSTRACT

Provided is technology enabling executing printing processes under conditions appropriate for a specific type of print medium without overburdening the print media vendor. A printing device includes: a printing mechanism configured to print images on an installed print medium; a controller configured to control a printing process based on the result of acquiring first information related to the media type of the print medium, and second information related to a condition used in a process printing images on print media by the printing mechanism; and a reader configured to read the first information of the print medium from memory affixed to the print medium installed to the printing mechanism. The controller acquires the second information, which includes a condition used when applying the printing process to a print medium of the media type indicated by the first information that was read by the reader, and controls the printing mechanism to run the printing process based on the second information.

10 Claims, 8 Drawing Sheets

I

| | VENDOR | PHYSICAL CONFIGURATION | IMAGE PROCESSING INFORMATION Ip1 | PRINT SETTINGS INFORMATION Ip2 |
|---|---|---|---|---|
| Mk | VA | VA1 | Ip11 | Ip21 |
| Mk | VA | VA2 | ... | ... |
| Mk | VB | VB1 | ... | ... |
| Mk | VB | VB2 | ... | ... |
| | ... | ... | ... | ... |
| | | | | |
| | Im | | Ip | |

FIG. 3

I

Is

| | BASIC SECTOR Rm | | EXTENSIBLE SECTOR Rp | | | |
|---|---|---|---|---|---|---|
| | VENDOR | PHYSICAL CONFIGURATION | MANUFACTURER | MODEL | IMAGE PROCESSING INFORMATION Ip1 | PRINT SETTINGS INFORMATION Ip2 |
| Mk | VA | VA1 | PA | PA1 | Ip11 | Ip21 |
| | | | | PA2 | ... | ... |
| | | | | PA3 | ... | ... |
| | | | PB | PB1 | ... | ... |
| | | | | PB2 | ... | ... |
| | | | ... | ... | ... | ... |
| | | | ... | ... | ... | ... |
| Mk | VA | VA2 | PA | PA1 | ... | ... |
| | | | | PA2 | ... | ... |
| | | | | PA3 | ... | ... |
| | | | PB | PB1 | ... | ... |
| | | | | PB2 | ... | ... |
| | | | ... | ... | ... | ... |
| | | | ... | ... | ... | ... |
| Mk | VB | VB1 | PA | PA1 | ... | ... |
| | | | | PA2 | ... | ... |
| | | | | PA3 | ... | ... |
| | | | PB | PB1 | ... | ... |
| | | | | PB2 | ... | ... |
| | | | ... | ... | ... | ... |
| | | | ... | ... | ... | ... |
| Mk | VB | VB2 | PA | PA1 | ... | ... |
| | | | | PA2 | ... | ... |
| | | | | PA3 | ... | ... |
| | | | PB | PB1 | ... | ... |
| | | | | PB2 | ... | ... |
| | | | ... | ... | ... | ... |
| | | | ... | ... | ... | ... |
| | ... | ... | ... | ... | ... | ... |
| | | | | | | |

Im

Ip

FIG. 4

PRINTER, PRINTING METHOD, AND PRINT MEDIUM

BACKGROUND

1. Technical Field

The present invention relates to technology enabling executing a printing process of positioning images to a print medium by a printing mechanism using conditions corresponding to the type of the print medium.

2. Related Art

Printing technology for generating print data representing an image to print, and enabling a printer to print the image on a print medium based on the print data, is known from the literature. In this event, there are many types of print media of different dimensions and materials, for example, that could be used for printing. Therefore, to print images desirably on a particular print medium, various conditions must be adjusted appropriately to the specific type of print medium used to print, such as the conditions used to generate the print data, and printing conditions set for the printing mechanism. To this end, JP-A-2004-205846 describes generating print data by applying color matching using the ICC (International Color Consortium) profile appropriate to the type of print medium.

However, a wide range of print media are now available from numerous vendors, and executing the printing process under conditions appropriate to the type of print medium is not simple for the user of the printing mechanism. JP-A-2012-076358 therefore describes affixing a RFID (Radio Frequency IDentifier) tag to the inside of the core on which the print medium is wound into a roll, and storing control information to use in the printing process in the RFID tag. The printing process is the executed using the control information read from the RFID tag.

However, the conditions (control information) that should be used in the printing process depend on the specific printing mechanism. In actual practice, therefore, it is extremely difficult for the print media vendor, who has no specialized knowledge about the specific printing mechanism, to determine the conditions (control information) that should be used in the printing process, and store the control information in a memory device such as an RFID tag. The technology disclosed in JP-A-2012-076358 is therefore not always effective as a practical solution to the problem of executing printing processes under conditions appropriate for a specific type of print medium.

SUMMARY

An objective of the present invention is to provide technology enabling executing printing processes under conditions appropriate for a specific type of print medium without overburdening the print media vendor.

A printing device according to the invention includes: a printing mechanism that prints images on the installed print medium; a controller configured to control a printing process based on the result of acquiring first information related to the media type of the print medium, and second information related to a condition used in a printing process that prints images on print media by the printing mechanism; and a reader configured to read the first information of the print medium from memory affixed to the print medium installed to the printing mechanism; the controller acquiring the second information including a condition used when executing the printing process on the print medium of the media type indicated by the first information that was read, and controlling the printing mechanism to run the printing process based on the second information.

Another aspect of the invention is a printing method including: a first step of acquiring first information related to the media type of the print medium from memory affixed to the print medium installed in the printing mechanism; a second step of acquiring, based on the first information, second information related to a condition used in a printing process to print images on print media by the printing mechanism; and a third step of applying a printing process to the print medium installed in the printing mechanism based on a condition indicated by the second information acquired in the second step.

Another aspect of the invention is a print medium product including: in addition to a print medium for printing, memory storing first information related to the media type of the print medium; and communicating with the printing mechanism in which the print medium is installed and causing the printing mechanism to acquire, based on the first information, second information used in a printing process of the print medium, and causing the printing mechanism to execute the printing process according to the condition indicated by the second information.

In this configuration of the invention, the printing process is controlled based on first information related to the media type of the print medium, and second information related to conditions used in the printing process. More specifically, first information of the print medium stored in memory affixed to the print medium installed in the printing mechanism is used. In this way, the content stored in memory is the first information related to the media type of the print medium, and can be known without the print media vendor requiring specialized knowledge about the printing mechanism. There is also a configuration for acquiring second information including conditions used in a printing process for printing on the print medium of the media type indicated by the first information, and the printing process is executed according to the conditions appropriate to the type of print medium installed in the printing mechanism. As a result, printing processes can be executed using conditions appropriate to the media type of the print medium without overburdening the vendor of the print medium.

In another aspect of the invention, the printing device may be configured to so that the controller has a table relationally storing the first information and second information to a media type, and acquires the second information from the table based on the first information read by the reader.

This configuration enables the controller to easily acquire the appropriate second information based on a locally stored table.

In another aspect of the invention, the printing device is configured so that the controller can acquire the second information from a server that stores, as media data, the first information and second information relationally to a media type.

This configuration enables the controller to acquire the required second information from a server.

In another aspect of the invention, the printing device is configured so that the controller stores, in a local table, the first information used to query the server, and the second information received from the server, relationally to the media type.

This configuration prevents querying the server again when print media of the same media type is next installed in the printing mechanism.

In another aspect of the invention, the printing device is configured so that the controller writes the second information received from the server to the memory.

When a print medium is removed from the printing mechanism and then again installed in the printing mechanism, this configuration enables executing the printing process using the conditions indicated by the second information that is read from the memory affixed to the print medium.

In another aspect of the invention, the printing device is configured so that the controller can acquire the second information by generating the second information.

This configuration enables the controller to conveyance direction X the printing process according the second information that is generated.

In another aspect of the invention, the second information can be generated in many ways.

For example, the controller may have an editor enabling a user to edit the second information, and updates the second information based on the content edited by the editor.

In another aspect of the invention, the printing device is configured so that the second information stored in a table includes image processing information used to generate print data appropriate to the media type identified by the related first information; and the printing device receives print data generated by an external device using the image processing information.

This configuration enables generating print data using image processing information appropriate to the media type of the print medium.

In another aspect of the invention, the printing device is configured so that the second information stored in the table includes print settings information set in the printing mechanism.

This configuration enables the printing mechanism to print images using print settings information appropriate to the media type of the print medium.

In another aspect of the invention, the printing device is configured with a writer that writes the second information to memory.

When the print medium is removed from the printing mechanism and then reinstalled to the printing mechanism, this configuration desirably enables executing the printing process based on the conditions indicated by the second information read from the memory affixed to the print medium.

In another aspect of the invention, the printing device is configured so that the writer writes the second information to memory together with information related to the model of printing mechanism.

This configuration enables accurately determining whether or not to use the second information stored in memory based on the model of the printing mechanism to use for printing.

In another aspect of the invention, the printing device is configured so that the writer writes the second information to the memory when triggered by the print medium product being removed from the printing mechanism.

This configuration can reliably write the second information to memory.

In another aspect of the invention, the print medium product is configured so that the second information can be acquired from the printing mechanism and stored to memory.

This configuration enables reading and using second information stored in memory in the printing process.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 3 shows an example of a data table stored by a management computer.

FIG. 4 shows an example of the data structure of media data stored on a media server.

DESCRIPTION OF EMBODIMENTS

Figure 1:
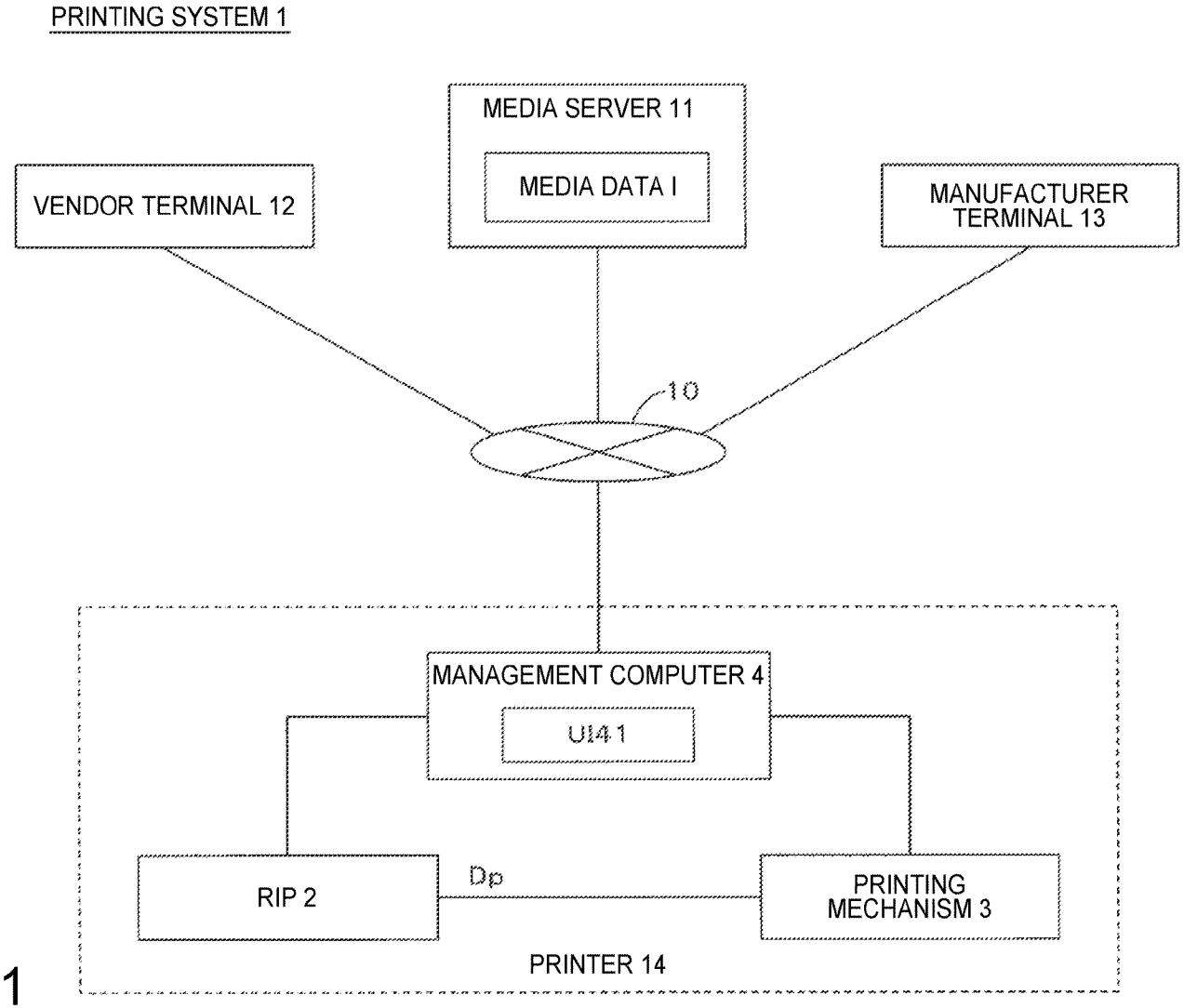
FIG. 1 is a block diagram illustrating a printing system including a printer according to a first example of the invention.

FIG. 1 is a block diagram illustrating a printing system including a printer according to a first example of the invention. The printing system 1 includes a media server 11, vendor terminal 12, manufacturer terminal 13, and printer 14 connected through the Internet 10.

The media server 11 is a computer that functions as a cloud server, and stores media data I containing information appropriate to specific types of print media. The media data I is described in detail below.

The vendor terminal 12 is a computer that is operated by a print media vendor, and the vendor can use the vendor terminal 12 to write to the media data I.

The manufacturer terminal 13 is a computer operated by the manufacturer that supplies the printing mechanism 3 of the printer 14, and the manufacturer can use the manufacturer terminal 13 to write to the media data I.

The printing system 1 is a global printing system configured so that multiple printers 14 used in different local environments (such as the corporate computing environment of the particular user) can access the media server 11.

The printer 14 is a local printing system installed in the local environment of the user for executing printing processes. More specifically, the printer 14 includes a raster image processor (RIP) 2, printing mechanism 3, and management computer 4 that controls the RIP 2 and printing mechanism 3, and executes a printing process causing the RIP 2 to generate print data Dp and the printing mechanism 3 to print the image expressed by the print data Dp.

The RIP 2 applies a color management process using an ICC profile to the image data, and rasterizes the resulting image data to generate the print data Dp (raster data). The print data Dp thus generated is then sent from the RIP 2 to the printing mechanism 3. The printing mechanism 3 is a printer that prints an image corresponding to the print data Dp on print media, and may be configured as shown in FIG. 2, for example.

Figure 2:
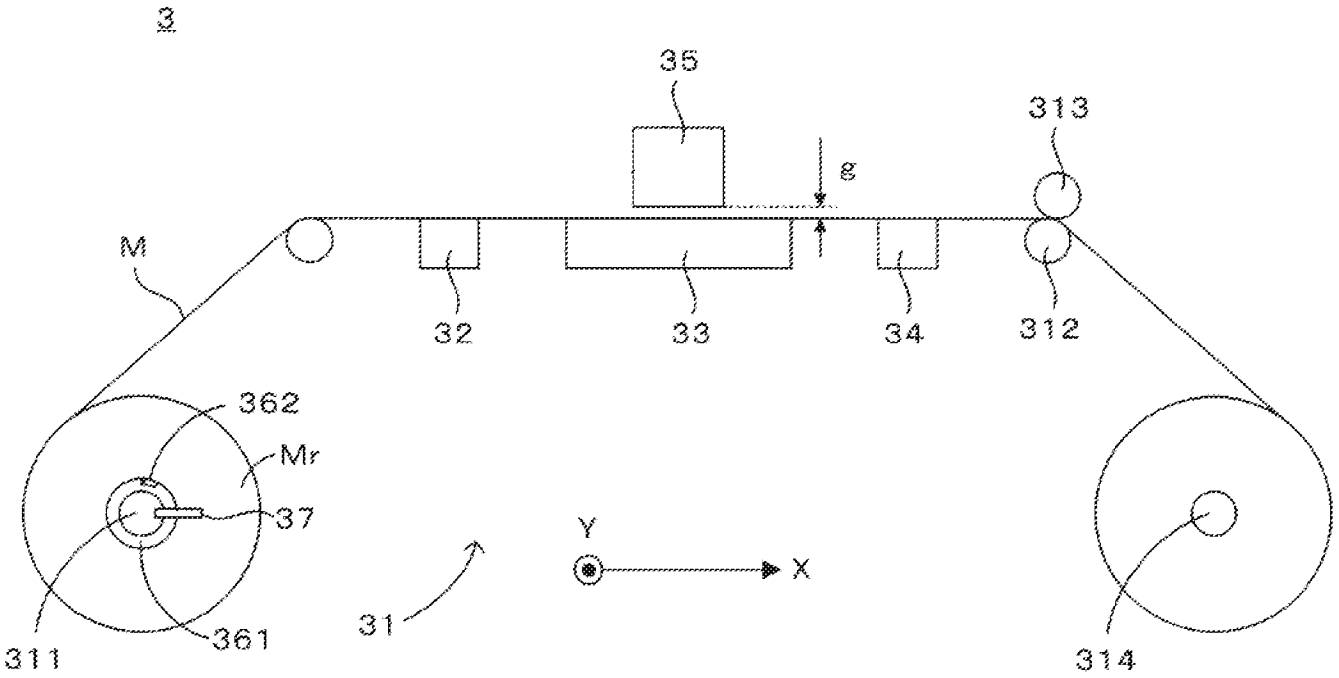
FIG. 2 schematically illustrates an example of a printer configuration.

FIG. 2 schematically shows an example of the configuration of the printing mechanism.

The printing mechanism 3 has a roll-to-roll conveyance mechanism 31 that conveys the print medium M in the conveyance direction X. This conveyance mechanism 31 includes sequentially in the conveyance direction X of the print medium M: a delivery roller 311, a pair of rollers 312, 313, and a take-up roller 314. The delivery roller 311 delivers the print medium M in the conveyance direction X from a paper roll. The pair of rollers 312, 313 hold the print medium M delivered by the delivery roller 311. One roller 313 is urged against the roller 312 to apply a constant load to the print medium M, and the roller 312 conveys the print medium M in the conveyance direction X while applying constant tension to the print medium M by applying specific torque to the print medium M. The take-up roller 314 then rewinds the print medium M conveyed from the pair of rollers 312, 313.

Between the delivery roller 311 and roller 312, the printing mechanism 3 has, sequentially in the conveyance direction X, a preheater 32, platen heater 33, and after heater 34, and heats the print medium M touching the tops of the heaters. The printing mechanism 3 also has a printhead 35 opposite the platen heater 33 with a specific platen gap g therebetween. The printhead 35 ejects ink using an inkjet printing method to the print medium M supported on the platen heater 33.

By the conveyance mechanism 31 intermittently conveying the print medium M in the conveyance direction X, the printing mechanism 3 advances an unprinted portion of the print medium M to the platen heater 33. The printhead 35 then executes a main scanning operation ejecting ink while moving in the scanning direction Y crosswise to the conveyance direction X. The number of passes the printhead 35 makes in the scanning direction Y can be desirably adjusted, and images are formed on the print medium M paused at the platen heater 33 by the printhead 35 executing the main scanning operation the specified number of sets. Furthermore, the drying time by the platen heater 33 of the ink that landed on the print medium M in the previous main scan is controlled by adjusting the interval between the multiple main scans.

The roll Mr of print media is removably installed on the delivery roller 311 of the 3. More specifically, the roll Mr of print medium M that is wound onto a core 361, and the roll Mr is installed by removing fitting the core 361 onto the delivery roller 311. The printing mechanism 3 then prints images on the print medium M conveyed from the installed roll Mr.

An RFID tag 362 storing basic media information Im for the print medium M on the roll Mr is affixed to the core 361.

The printing mechanism 3 also has a reader/writer 37 for reading and writing to the RFID tag 362, and the reader/writer 37 reads information from and writes to the RFID tag 362 of the core 361 mounted on the delivery roller 311. Note that the basic media information Im stored in the RFID tag 362, and a method of using the basic media information Im read from the RFID tag 362, are described below.

Referring again to FIG. 1, the printer 14 controls the RIP 2 and printing mechanism 3 by the management computer 4. More particularly in this example, the management computer 4 controls operation of the RIP 2 and the printing mechanism 3 according to the media type of the print medium M. More particularly in this embodiment of the invention, the management computer 4 controls the operation of the RIP 2 and printing mechanism 3 according to the type of print medium M. More specifically, the ICC profile that should be used in the color management process executed by the RIP 2 differs according to the type of print medium M. The management computer 4 therefore sets the ICC profile in the RIP 2 appropriately to the type of print medium M set to be used in the printing process, and the RIP 2 then generates the print data Dp using the ICC profile that was set.

When printing by the printing mechanism 3, one or more machine parameters may change according to the type of print medium M. The machine parameters may include, for example, the tension on the print medium M, the load of the roller 313, the specific platen gap g, the number of passes in the main scanning direction, the interval between main scans, the interval between passes, the temperature of the preheater 32, the temperature of the platen heater 33, and the temperature of the after heater 34. The management computer 4 therefore sets the machine parameters in the printing mechanism 3 according to the type of print medium M scheduled to be used in the printing process, and the printing mechanism 3 prints using the set machine parameters.

To use the ICC profile and machine parameters corresponding to the media type of the print medium M, the management computer 4 stores a table (FIG. 3) describing the relationship therebetween in memory. FIG. 3 shows an example of a data table stored by the management computer 4.

As shown in FIG. 3, the table T stores basic media information Im related to a particular print medium M for specific media types Mk. The basic media information Im includes the vendor VA, VB, and so forth of the print medium M of a particular media type Mk, and the physical configuration VA1, VA2 of that media type Mk. If the media type Mk is different, at least some of the vendor VA, Vb and physical configuration VA1, VA2 information in the basic media information Im is different. In other words, the media type Mk is differentiated by the specific combination of vendor VA, VB and physical configuration VA1, VA2 information.

The physical configuration of the print medium M may include, for example, the length of the print medium M, the width of the print medium M, the thickness of the print medium M, the grammage of the print medium M, the material of the print medium M (such as paper, film, and laminates thereof), absorptivity of the print medium M, color of the print medium M, and whether or not there is adhesive on the print medium M.

The table T stores the printing profile Ip related to the conditions used in the printing process. More specifically, the table T stores a printing profile Ip related to the basic media information Im corresponding to the media type Mk of the print medium M to process in the printing process. In this example, the printing profile Ip includes image processing information Ip1, and print settings information Ip2. The image processing information Ip1 describes the image processing conditions, such as the ICC profile used to generate the print data Dp. The print settings information Ip2 describes the print settings conditions, such as the machine parameters used when the printing mechanism 3 prints the image expressed by the print data Dp.

The table T thus relationally stores basic media information Im and a printing profile Ip for each media type Mk, and supplies the printing profile Ip to be used when printing on print medium M of the specific media type Mk. For example, when applying the printing process to print medium M of the media type Mk identified by vendor VA and physical configuration VA1, the printing profile Ip including image processing information Ip11 and print settings information Ip21 is applied.

When a vendor starts selling a print medium M of a new media type Mk, the number of media types Mk of print media M that can be used in printing processes increases. However, basic media information Im and a printing profile Ip appropriate to the new media type Mk is not stored in the table T. To handle this situation, the printing system 1 in FIG. 1 cumulatively stores basic media information Im and a printing profile Ip relationally for each media type Mk as media data I on a media server 11 in the cloud (a cloud server).

FIG. 4 shows an example of the data structure of media data stored by the media server. The data structure Is of the media data I includes a basic sector Rm and an extensible sector Rp. The basic sector Rm is used to store basic media information Im related to a specific print medium M for each media type Mk. If the media type Mk is different, the vendor VA, VB or the physical configuration VA1, VA2 in the basic media information Im in the media data I is different. In other words, the media type Mk is differentiated by the specific combination of vendor VA, VB and physical configuration VA1, VA2.

Note that the basic media information Im in this embodiment is written in XML (eXtensible Markup Language).

The extensible sector Rp is used to store the printing profile Ip related to the conditions used in the printing process. Data may be stored in the extensible sector Rp in various ways, such as storing the ICC profile as binary data, and the machine parameters as text data. The machine parameters may also be stored in a file format such as a CPB file, and the ICC profile may be stored in a file format such as an ICC file. A print medium file is embodied by the CPB file and ICC file.

More specifically, the extensible sector Rp stores a printing profile Ip related to the basic media information Im corresponding to the media type Mk of the print medium M processed in the printing process. The extensible sector Rp thus stores a printing profile Ip for each media type Mk. In addition, the extensible sector Rp can store multiple printing profiles Ip for the same media type Mk. The multiple printing profiles Ip related to the same media type Mk are for different models (types) of printing mechanisms 3. In other words, the extensible sector Rp can store a specific printing profile Ip for printing mechanism models PA1, PA2, and so forth. In this case, in the extensible sector Rp, the multiple printing profiles Ip related to the same media type Mk are grouped by the manufacturer PA, PB, and so forth of the specific printing mechanism 3.

The media data I thus defines the printing profile Ip to be used when a specific model of printing mechanism 3 prints to a print medium M of a specific media type Mk. For example, when printing with a printing mechanism 3 of model PA1 from manufacturer PA on a print medium M of media type Mk identified by the vendor VA and physical configuration VA1, the printing profile Ip containing image processing information Ip11 and print settings information Ip21 is applied.

The media data I is created jointly by the vendor of the print medium M and the manufacturer of the printing mechanism 3. More specifically, the print medium M vendor writes the basic media information Im for a print medium M sold by the vendor to the basic sector Rm. The manufacturer of the printing mechanism 3 then determines the optimal printing profile Ip to use when using the printing mechanism 3 to print on a print medium M of the media type Mk identified by the basic media information Im, and writes the printing profile Ip to the extensible sector Rp.

As described above, however, the print medium M is removably installed to the printing mechanism 3. When the print medium M in the printing mechanism 3 is replaced, the media type Mk of the print medium M installed in the printing mechanism 3 may therefore change. In this situation, the printing system 1 enables executing the printing process based on the printing profile Ip appropriate to the media type Mk of the print medium M installed in the printing mechanism 3. An example of the operation of the printing system 1 is described next.

Figure 5:
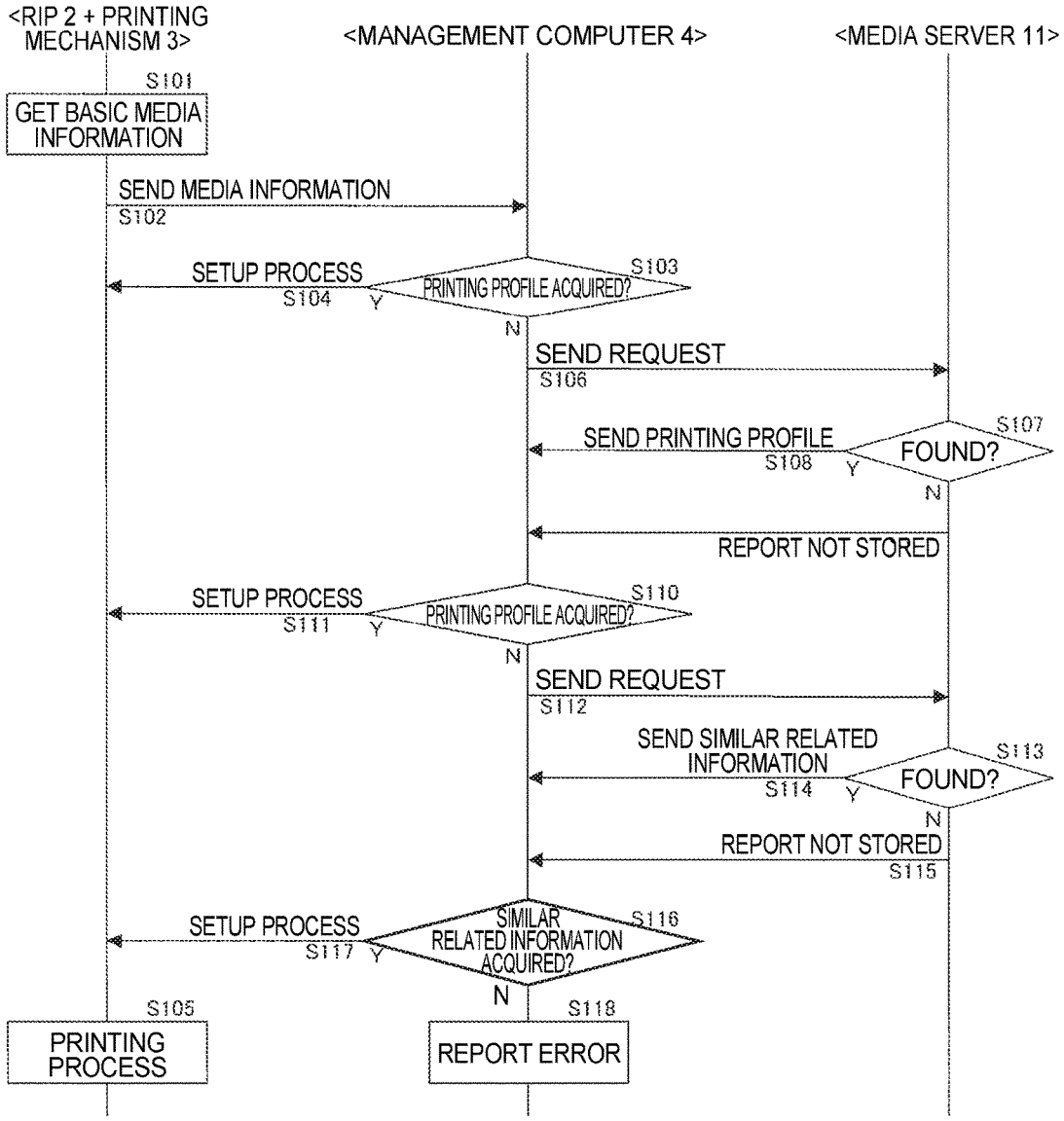
FIG. 5 is a flow chart illustrating an example of a first operation that can be executed by the printing system in FIG. 1.

FIG. 5 is a flow chart of a first example of the operation of the printing system 1 in FIG. 1. Note that a YES result is denoted Y, and a NO result is denoted N, in decision steps described below and in the figures.

When a print medium M is loaded in the printing mechanism 3, the basic media information Im of the print medium M is read by the reader/writer 37 from the RFID tag 362 associated with that print medium M (step S101). Next, the printing mechanism 3 sends the basic media information Im read by the reader/writer 37 to the management computer 4 (step S102). The management computer 4 then looks for the printing profile Ip related to the received basic media information Im in the table T (step S103).

If the result of the search is that the printing profile Ip is in the table T and can be acquired from the table T (step S103: Y), the management computer 4 executes a configuration process that sets the conditions described by the printing profile Ip in the RIP 2 and printing mechanism 3 (step S104). More specifically, the image processing conditions (such as the ICC profile) identified by the image processing information Ip1 of the printing profile Ip is set in the RIP 2, and the printing conditions (such as the machine parameters) indicated by the print settings information Ip2 of the printing profile Ip are set in the printing mechanism 3. The printing process whereby RIP 2 generates the print data Dp and the printing mechanism 3 prints the image indicated by the print data Dp is then applied to the print medium M installed in the printing mechanism 3 (step S105).

However, if the search result is that the corresponding printing profile Ip is not stored in the table T and cannot be acquired from the table T (step S103: N), the management computer 4 sends to the media server 11 a request signal requesting the printing profile Ip related to the basic media information Im received from the printing mechanism 3 (step S106).

The media server 11 receives this request signal, and searches the media data I for the corresponding printing profile Ip (step S107). Note that this request signal includes information specifying the model of the printing mechanism 3, and the media server 11 searches for the printing profile Ip corresponding to the specified model. If the desired printing profile Ip is stored in the media data I (step S107: Y), the printing profile Ip is sent from the media server 11 to the management computer 4 (step S108).

More specifically, the media server 11 creates a file from the basic media information Im and printing profile Ip, and sends the file to the management computer 4 of the printer 14.

This file may be formatted as a zip archive, for example. In this event, the file can be generated by compressing the XML file, CPB file, and ICC file in a zip format. The media server 11 then sends an appropriate print medium file to the printer 14 that sent the request, and the management computer 4 can acquire the printing profile Ip corresponding to the type of print medium M to be used in the printing process Mk and model of printing mechanism 3.

If the desired printing profile Ip is not stored in the media data I (step S107: N), a signal reporting that the printing profile Ip is not stored is sent from the media server 11 to the management computer 4 (step S109). In step S110, the management computer 4 determines, as a result of querying the media server 11 (sending a request), if the printing profile Ip was acquired from the media server 11.

If the printing profile Ip was acquired in step S108 (step S110: Y), the management computer 4 configures the RIP 2 and printing mechanism 3 according to the conditions indicated by the printing profile Ip acquired in step S108 (step S111), and the RIP2 and printing mechanism 3 then execute the printing process (step S105).

If the signal reporting that the printing profile Ip is not stored was sent from the media server 11 to the management computer 4 in step S109, and the printing profile Ip could not be acquired (step S110: N), the management computer 4 goes to step S112.

In step S112, the management computer 4 sends to the media server 11 a request signal requesting the printing profile Ip related to basic media information Im similar to the basic media information Im received from the printing mechanism 3. The media server 11 receives this request signal and searches the media data I for a similar printing profile Ip (step S113).

More specifically, the media server 11 looks for a printing profile Ip related to basic media information Im in which specific parameters contained in the physical configuration indicated by the basic media information Im match, in descending order of priority, the basic media information Im received from the printing mechanism 3. Examples of such high priority parameters include the material, width, grammage, and color of the print medium M.

Note that the same information identifying the model of the printing mechanism 3 contained in the request signal sent in step S106 is included in the request signal sent in step S112, and the search in step S113 includes the specified model.

If the desired printing profile Ip is included in the media data I (step S113: Y), that printing profile Ip is sent as the similar related information from the media server 11 to the management computer 4 (step S114).

If the desired printing profile Ip is not included in the media data I (step S113: N), a signal reporting the information is not stored is sent from the media server 11 to the management computer 4 (step S115).

In step S116 the management computer 4 determines if similar related information was acquired from the media server 11 as a result of sending a request (request signal) to the media server 11. If in step S114 similar related information was acquired (step S116: Y), the management computer 4 configures the RIP 2 and printing mechanism 3 according to the conditions indicated by the printing profile Ip acquired in step S114 (step S117), and the RIP2 and printing mechanism 3 then execute the printing process (step S105). However, if a signal reporting the information is not stored is received in step S115 and similar related information was not acquired (step S116: N), the management computer 4 reports an error to the user (step S118).

In the embodiment described above, the printing process is controlled based on the result of acquiring basic media information Im corresponding to the media type Mk of the print medium M, and a printing profile Ip related to conditions used in the printing process. More specifically, the basic media information Im is read from an RFID tag 362 storing the basic media information Im of the print medium M installed in the printing mechanism 3 (step S101). The content stored in the RFID tag 362 is basic media information Im related to the media type Mk of the print medium M, and can be known without the vendor of the print medium M needing specific technical knowledge about the printing mechanism 3. The printer 14 has a configuration (management computer 4) for acquiring printing profile Ip indicating conditions used in the printing process appropriate to the media type Mk of the print medium M indicated by the basic media information Im (step S103, S110), and executes a printing process using conditions appropriate to the media type Mk of the print medium M installed in the printing mechanism 3 (step S105). As a result, printing processes can be executed using conditions appropriate to the media type Mk of the print medium M without overburdening the vendor of the print medium M.

The management computer 4 stores a table T relationally storing basic media information Im and printing profile Ip to specific media types Mk. The management computer 4 can acquire the appropriate printing profile Ip by searching the table T for the printing profile Ip related to the basic media information Im read by the reader/writer 37 (step S103). This configuration enables the management computer 4 to easily acquire the appropriate printing profile Ip by searching a table T stored by the management computer 4.

When the printing profile Ip cannot be found in the table T, the management computer 4 queries a media server 11 that stores basic media information Im and printing profile Ip relationally to media types Mk as a table T (step S106). The media server 11 finds in the table T and sends to the management computer 4 the printing profile Ip related to the basic media information Im in the query (step S107, S108). The management computer 4 thus acquires the printing profile Ip from the media server 11 (step S108, S110). This configuration enables acquiring the required printing profile Ip even when the printing profile Ip is not stored in the table T on the management computer 4.

The management computer 4 may also store the basic media information Im related to the query to the media server 11 relationally to the printing profile Ip received from the media server 11 in the table T. As a result, there is no need to query the media server 11 again when a print medium M of the same media type Mk is again installed in the printing mechanism 3.

Furthermore, synchronized to storing the table T, the management computer 4 may write the printing profile Ip received from the media server 11 to the RFID tag 362 by the reader/writer 37. As a result, a printing profile Ip and basic media information Im corresponding to the media type Mk of the print medium M wound onto the core 361 are stored in the RFID tag 362. As a result, when the print medium M is removed from the printing mechanism 3 and later reinstalled to the printing mechanism 3, the printing process can be desirably executed according to the conditions defined by the printing profile Ip read from the RFID tag 362 for that print medium M.

If the printing profile Ip cannot be found in the media data I, the media server 11 executes the following operation.

That is, the media server 11 sends to the management computer 4 a printing profile Ip related to the basic media information Im satisfying a specific relationship (matching a specific parameter in the multiple parameters of the physical configuration) to the basic media information Im read by the reader/writer 37 from the printing profile Ip stored in the media data I (step S114). The management computer 4 then drives the RIP 2 and printing mechanism 3 to execute the printing process according to the conditions indicated by the printing profile Ip received from the media server 11 (step S105). As a result, the printing process can be desirably executed even when the desired printing profile Ip is not stored in the media data I of the media server 11.

The printer 14 has a RIP 2 that generates print data Dp, in the printing process, the printing mechanism 3 prints the image indicated by the print data Dp generated by the RIP 2 on the print medium M. The printing profile Ip stored in the table T includes image processing information Ip1 used to generate the print data Dp according to the media type Mk corresponding to the related basic media information Im. The RIP 2 uses the image processing information Ip1 included in the printing profile Ip found in the table T to generate the print data Dp. As a result, the print data Dp can be generated using image processing information Ip1 appropriate the media type Mk of the print medium M.

The printing profile Ip stored in the table T includes print settings information Ip2 that is set in the printing mechanism 3 according to the media type Mk corresponding to the related basic media information Im. The print settings information Ip2 contained in the printing profile Ip found from the table T is then set for the printing mechanism 3. As a result, images can be printed by the printing mechanism 3 using print settings information Ip2 appropriate to the media type Mk of the print medium M.

Figure 6:
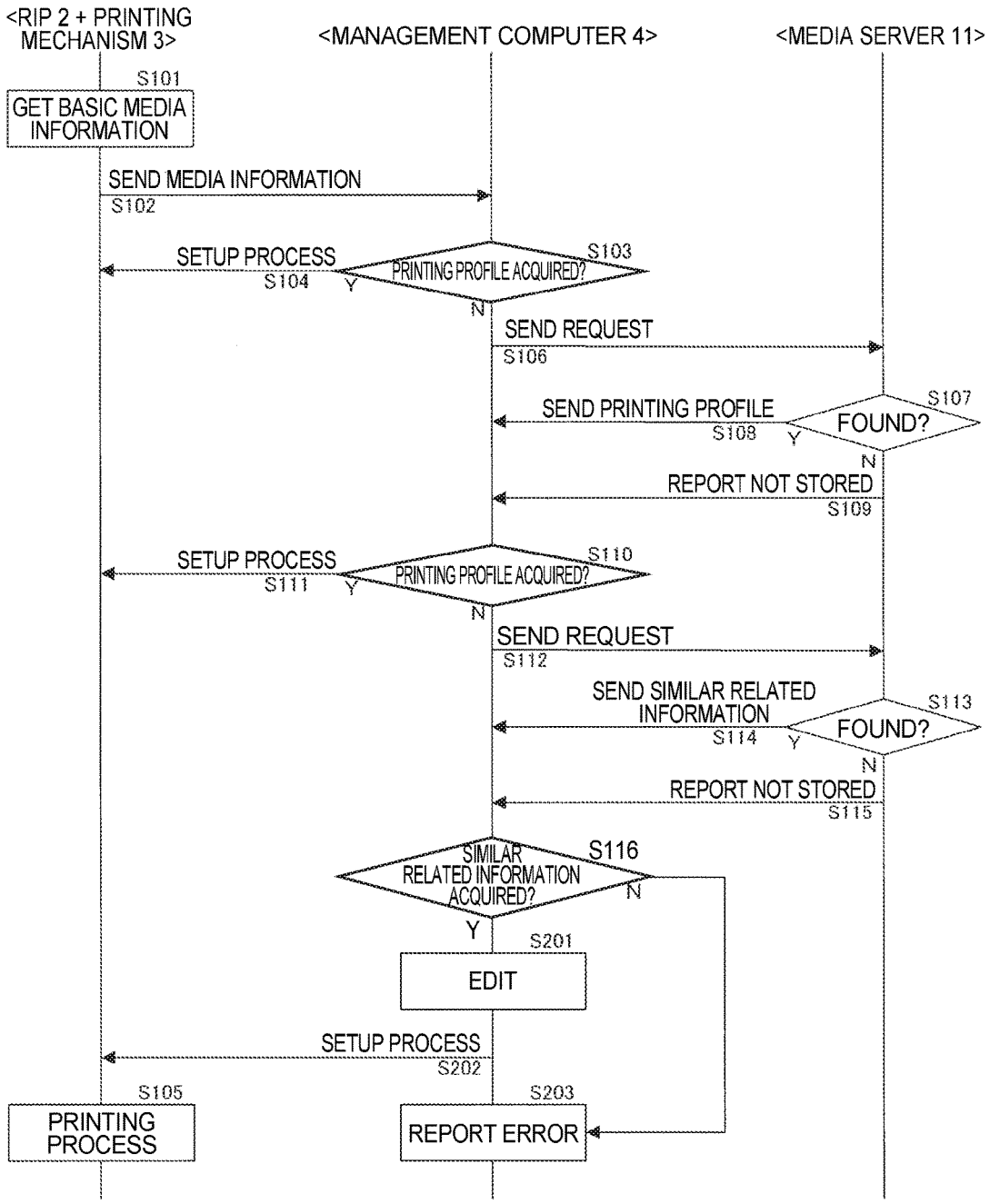
FIG. 6 is a flow chart illustrating an example of a second operation that can be executed by the printing system in FIG. 1.

FIG. 6 is a flow chart of a second example of an operation the printing system 1 shown in FIG. 1 can execute. This process is described below with particular attention to the differences with the embodiment described above, common configurations are identified by like reference numerals, and further description is omitted or abbreviated. It will be obvious that the same effect will be achieved by using configurations common to the above embodiment.

In the second operation shown in FIG. 6, operation is the same as the first operation shown in FIG. 5 until step S116. The second operation shown in FIG. 6 differs from the operation in FIG. 5 in the management computer 4 generating the desired printing profile Ip based on the similar related information acquired from the media server 11. In other words, when the management computer 4 acquires the similar related information from the media server 11 (step S116: Y), the management computer 4 edits the similar related information acquired from the media server 11 and generates a new printing profile Ip (step S201).

In one specific example, the value of the specific gap g to be set in the printing mechanism 3 is related to the thickness of the print medium M, and the specific platen gap g must be increased as the thickness of the print medium M increases. The management computer 4 therefore stores information indicating the correlation (a function or data table, for example) between the thickness of the print medium M and the appropriate platen gap g. The management computer 4 then applies this correlation to the thickness of the print medium M indicated by the basic media information Im related to the similar related information in the media data I to obtain the optimum platen gap g. The printing profile Ip is generated by updating the value of the platen gap g contained in the similar related information to this optimum value.

In another example, the temperature of the after heater 34 is correlated to the absorptivity of the print medium M, and the temperature of the after heater 34 must be increased as the absorptivity of the print medium M decreases. The management computer 4 therefore stores information indicating the correlation between the absorptivity of the print medium M and the temperature of the after heater 34. The management computer 4 then applies this correlation to the absorptivity of the print medium M indicated by the basic media information Im related to the similar related information in the media data I to obtain the optimum temperature of the after heater 34. The printing profile Ip is generated by updating the value of the after heater 34 temperature contained in the similar related information to this optimum temperature.

The setup process is then executed based on the printing profile Ip generated in step 201 (step S202), and the RIP2 and printing mechanism 3 run the printing process (step S105).

However, if a signal reporting the information is not stored is received in step S115 and similar related information was not acquired (step S116: N), the management computer 4 reports an error to the user (step S118).

Figure 7:
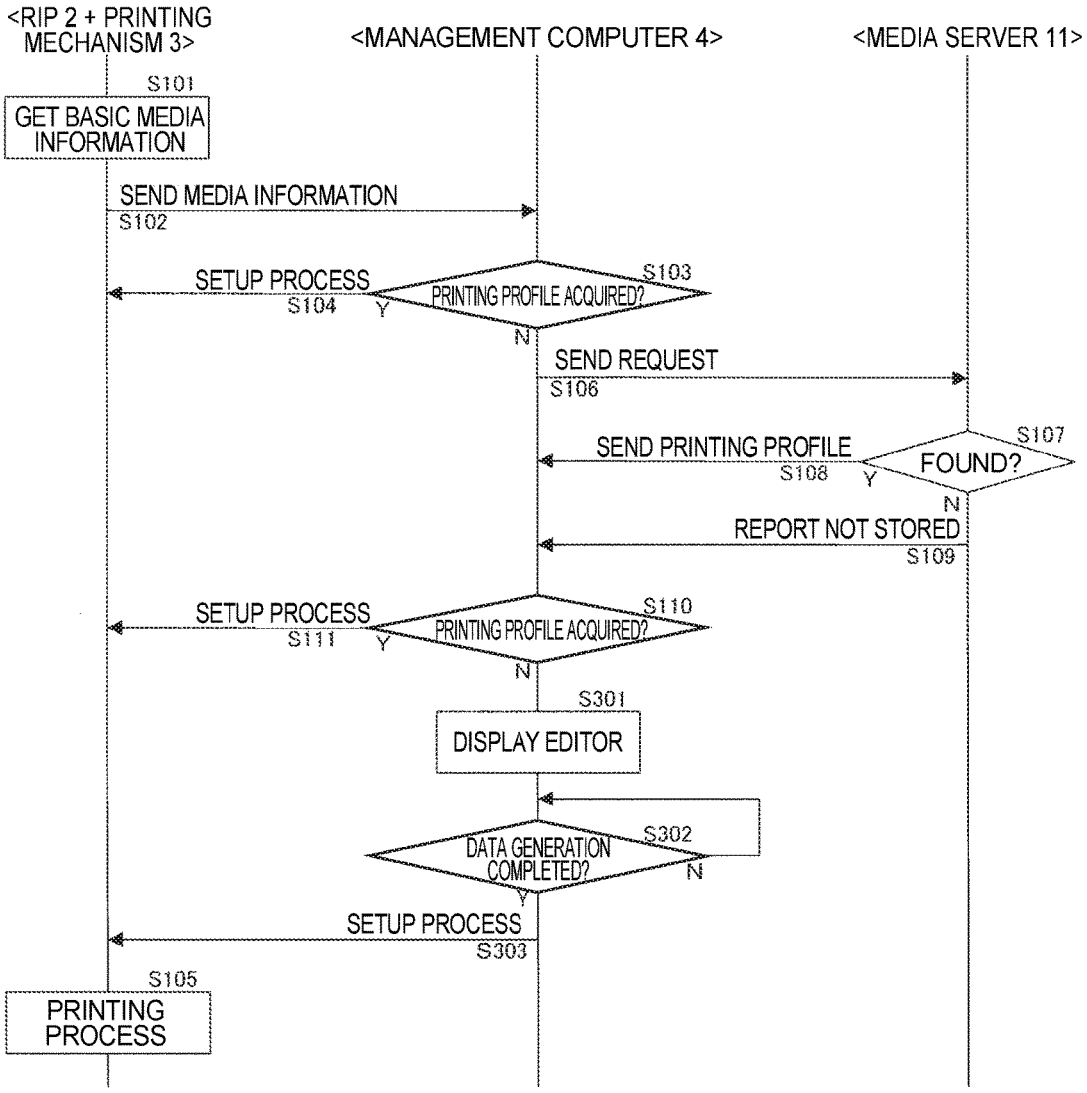
FIG. 7 is a flow chart illustrating an example of a third operation that can be executed by the printing system in FIG. 1.

FIG. 7 is a flow chart of a third example of an operation the printing system 1 shown in FIG. 1 can execute. This process is described below with particular attention to the differences with the embodiments described above, common configurations are identified by like reference numerals, and further description is omitted or abbreviated. It will be obvious that the same effect will be achieved by using configurations common to the above embodiment.

In the third operation shown in FIG. 7, operation is the same as the first operation shown in FIG. 5 until step S111. However, in the third operation in FIG. 7, when the printing profile Ip cannot be acquired from the media server 11 (step S110: N), the operation differs from the first operation in FIG. 5 in generating the desired printing profile Ip.

More specifically, if step S110 returns N, the management computer 4 presents a screen for generating the printing profile Ip in the user interface 41 (FIG. 1) (step S301). The user can then edit various variables in the printing profile Ip through the editing controls in the user interface 41, and attempt to execute the printing process. When the desired results are obtained and the user inputs a command indicating generating the printing profile Ip is completed, the printing profile Ip configured by the user is determined to be a new printing profile Ip (step S302: Y). The setup process is then executed using the printing profile Ip updated in step 302 (step S303), and the RIP2 and printing mechanism 3 run the printing process (step S105).

In the second and third operations described above, when the media server 11 cannot find the printing profile Ip in the media data I, the management computer 4 generates a printing profile Ip and executes the printing process using the conditions defined in the generated printing profile Ip. The printing process can therefore be executed even when the appropriate printing profile Ip is not stored in the media data I of the media server 11.

The management computer 4 may also relationally store the basic media information Im related to the query to the media server 11, and the printing profile Ip that was generated, in the table T. This configuration enables using the printing profile Ip stored in a table T the next time print medium M of the same media type Mk is installed in the printing mechanism 3.

Furthermore, synchronized to storing the table T, the management computer 4 may write the printing profile Ip that was generated to the RFID tag 362 by the reader/writer 37. As a result, a printing profile Ip and basic media information Im corresponding to the media type Mk of the print medium M wound onto the core 361 are stored in the RFID tag 362. As a result, when the print medium M is removed from the printing mechanism 3 and later reinstalled to the printing mechanism 3, the printing process can be desirably executed according to the conditions defined by the printing profile Ip read from the RFID tag 362 for that print medium M.

In the embodiments described above, the printer 14 is an example of a printing device of the invention; the printing mechanism 3 is an example of a printing mechanism of the invention; the management computer 4 is an example of a controller and management computer of the invention; the user interface 41 is an example of an editor of the invention; the reader/writer 37 is an example of a reader and a writer of the invention; the RFID tag 362 is an example of memory of the invention; the media server 11 is an example of a server of the invention; the RIP 2 is an example of a data generator of the invention; the table T is an example of a table of the invention; the media data I is an example of a media data of the invention; the basic media information Im is an example of first information of the invention; the printing profile Ip is an example of second information of the invention; the image processing information Ip1 is an example of a image processing information of the invention; print settings information Ip2 is an example of print settings information of the invention; the print medium M is an example of a print medium of the invention; and the print data Dp is an example of print data of the invention.

The invention is not limited to the foregoing embodiments, and can be varied in many ways without departing from the scope of the invention. For example, the configuration of the printing system 1 may be changed as shown in FIG. 8.

Figure 8:
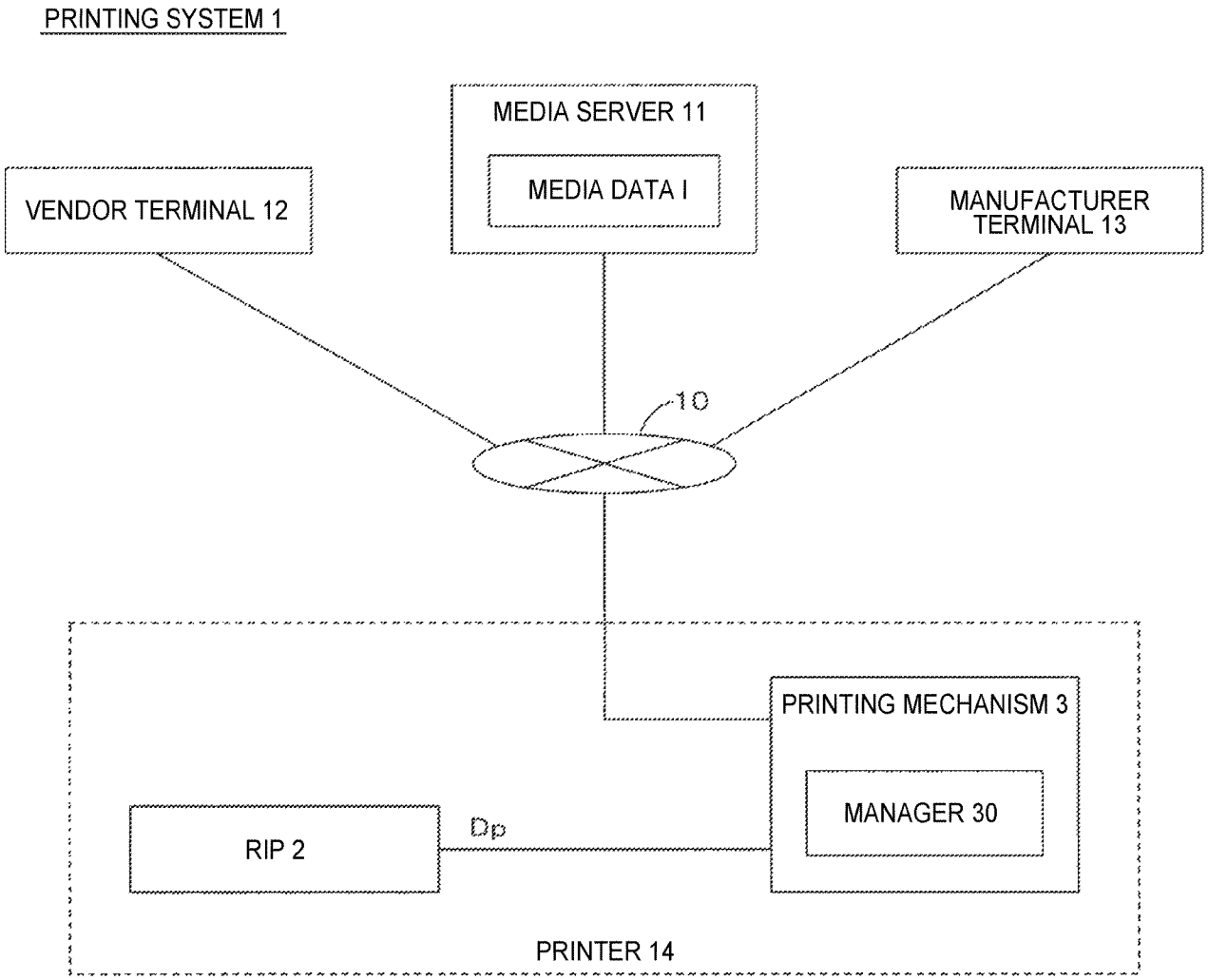
FIG. 8 is a block diagram illustrating a printing system including a printer according to a second example of the invention.

FIG. 8 is a block diagram of a second example of a printing system according to the invention. In the printing system 1 in FIG. 8, a manager 30 (controller), which is a computer comprising a CPU (central processing unit) and RAM (random access memory), is built into the printing mechanism 3. The manager 30 handles the function of the management computer 4 described above.

An example of the reader/writer 37 writing printing profile Ip that is acquired from the media server 11 or newly generated in the RFID tag 362. In this event, the reader/writer 37 may write information related to the model of printing mechanism 3 with the printing profile Ip in the RFID tag 362. In this case, by comparing the model of printing mechanism 3 stored in the RFID tag 362 with the model of the connected printing mechanism 3, whether or not the printing profile Ip stored in the RFID tag 362 can be used in the printing process can be accurately determined.

The timing for writing the printing profile Ip to the RFID tag 362 is not described above. However, the management computer 4 may write the printing profile Ip to the RFID tag 362 triggered by an operation whereby the print medium M is removed from the printing mechanism 3. As a result, the printing profile Ip can be reliably written to the RFID tag 362.

The information that can be included in the basic media information Im is also not limited to the foregoing. For example, the name of the print medium M, the model of the printing mechanism 3 suited to printing on the print medium M, a message from the vendor when using the print medium M, or information indicating when the basic media information Im was updated, may be included in the basic media information Im.

The example in FIG. 2 prints on the outside surface of the print medium M supplied in a roll, but configurations that print on the inside surface of the print medium M are conceivable. In this case, information indicating whether the inside surface or outside surface of the rolled print medium M is the printing surface may be included in the basic media information Im.

Furthermore, the basic media information Im is not limited to including information from the vendor of the print medium M, and information from the manufacturer of the printing mechanism 3 may be included in the basic media information Im. An example of such information is a message from the manufacturer when printing on the print medium M by a specific model of printing mechanism 3.

The information included in the image processing information Ip1 is also not limited to the foregoing. For example, when the print data Dp to be generated differs according to the number of passes, the number of passes (print mode) may be included in the image processing information Ip1. In addition, a color lookup table used for color conversions, the resolution of the printed image, or a table indicating the size of the ink droplets ejected for each dot, may also be included in the image processing information Ip1.

The information that can be included in the print settings information Ip2 is not limited to the foregoing. For example, when the printing mechanism 3 has a drying fan for drying the print medium M, the speed of the drying fan, for example, may be included in the print settings information Ip2. When the printing mechanism 3 is an inkjet printing mechanism, maintenance of the printhead 35 may be executed. More specifically, maintenance such as capping the nozzle face of the printhead 35 in which the ink ejection nozzles are formed with a cap, or vacuuming the nozzles by applying negative pressure to the nozzles while the nozzle face is capped, may be performed. Therefore, the frequency of maintenance, or the negative pressure applied (cleaning level) when vacuuming the nozzles, may be included in the print settings information Ip2.

Including all of the specific examples of basic media information Im described above in the basic media information Im is also not necessary, and a subset of this information may be included in the basic media information Im. The same applies to the image processing information Ip1 and print settings information Ip2.

The number of printing mechanisms 3 in the printer 14 is also not limited to one, and multiple printing mechanisms 3 may be included. In this case, the management computer 4 may acquire and set a printing profile Ip for the media type Mk of the print medium M used by a particular printing mechanism 3. Multiple printing mechanisms 3 may be connected by a local area network in this case.

The RFID tag 362 is also not limited to being disposed as described above, and the location of the RFID tag 362 may be changed as desired. The specific configuration of the memory (storage) storing the basic media information Im of the print media M is also not limited to an RFID tag 362.

The location of the reader/writer 37 is also not limited to the foregoing. More specifically, the reader/writer 37 is incorporated in the printing mechanism 3 in the example described above. However, the reader/writer 37 may be disposed separately from the printing mechanism 3. In this case, the reader/writer 37 may be configured to connect to the management computer 4 through a cable, and the reader/writer 37 may send the basic media information Im that was read through the cable to the management computer 4.

Furthermore, the management computer 4 does not necessarily need to store the table T. In this case, steps S103 and S104 may be omitted, and step S106 executed. In other words, when basic media information Im is received from the printing mechanism 3 (step S102), the management computer 4 may send the printing profile Ip related to the basic media information Im to the media server 11 (step S106).

The printing mechanism 3 is also not limited to an inkjet printer, and may be a laser printer or other type of printer.

The invention being thus described, it will be obvious that it may be varied in many ways. Such variations are not to be regarded as a departure from the spirit and scope of the invention, and all such modifications as would be obvious to one skilled in the art are included within the scope of the following claims.

The entire disclosure of Japanese Patent Application No. 2016-218647, filed Nov. 9, 2016, is expressly incorporated by reference herein.

What is claimed is:

1. A printing device comprising:

a printing mechanism configured to print images on the print medium of an installed print media product;

a controller configured to control a printing process based on the result of acquiring first information related to the media type of the print medium, and second information related to a condition used in a process printing images on print media by the printing mechanism; and a reader configured to read the first information related to the media type from memory affixed to the print medium product, which is installed to the printing mechanism;

the controller acquiring the second information including a condition used when printing on the media type indicated by the first information that was read, and controlling the printing mechanism to run the printing process based on the second information.

2. The printing device described in claim 1, wherein:

the controller has a table relationally storing the first information and second information to a media type, and acquiring the second information from the table based on the first information read by the reader.

3. The printing device described in claim 1, wherein:

the controller acquires the second information from a server that stores, as media data, the first information and second information relationally to a media type.

4. The printing device described in claim 3, wherein:

the controller stores, in a local table, the first information used to query the server, and the second information received from the server, relationally to the media type.

5. The printing device described in claim 1, wherein:

the controller has an editor enabling a user to create and edit the second information, and acquires the second information from the editor.

6. The printing device described in claim 1, wherein:

the second information includes image processing information used to generate print data appropriate to the media type identified by the related first information; and the printing device receives print data generated using the image processing information from an external device and prints.

7. The printing device described in claim 1, wherein:

the second information includes print settings information set in the printing mechanism.

8. The printing device described in claim 3, wherein:

the controller writes the second information received from the server to the memory.

9. The printing device described in claim 8, wherein:

the second information is written to the memory together with information related to the model of printing mechanism.

10. The printing device described in claim 8, wherein:

the second information is written to the memory when triggered by the print medium product being removed from the printing mechanism to which it was installed.

* * * * *